United States Patent [19]

Akaba et al.

[11] 4,217,736

[45] Aug. 19, 1980

[54] METHOD FOR AUTOMATICALLY GRINDING LENSES

[75] Inventors: Hayao Akaba, Akishima; Akira Ikeda, Fussa; Masayoshi Lee, Kawasaki, all of Japan

[73] Assignee: Kabushiki Kaisha Hoya Lens, Tokyo, Japan

[21] Appl. No.: 838,056

[22] Filed: Sep. 30, 1977

Related U.S. Application Data

[60] Division of Ser. No. 690,781, May 27, 1977, Pat. No. 4,096,684, which is a continuation-in-part of Ser. No. 490,188, Jul. 19, 1974.

[30] Foreign Application Priority Data

Oct. 11, 1973 [JP] Japan ..... 48-114211

[51] Int. Cl.[2] ..... B24B 1/00

[52] U.S. Cl. ..... 51/284 E

[58] Field of Search ..... 51/5 R, 101 R, 101 LG, 51/165.72, 283 E, 284 R, 284 E; 90/13.4

[56] References Cited

U.S. PATENT DOCUMENTS

| | | | |
|---|---|---|---|
| 2,397,933 | 4/1946 | Fowle | 51/165.72 X |
| 2,404,770 | 7/1946 | Bennett | 51/165.72 |
| 2,460,491 | 2/1949 | Cooke | 51/165.72 X |
| 3,507,075 | 4/1970 | Schmidt | 51/165.72 |
| 3,555,739 | 1/1971 | Novak | 51/101 LG |
| 3,619,617 | 11/1971 | Kolb | 51/165.72 X |
| 3,771,265 | 11/1973 | Bright | 51/101 LG |
| 4,003,165 | 1/1977 | Saun | 51/101 LG |

FOREIGN PATENT DOCUMENTS

| | | |
|---|---|---|
| 7424938 | 4/1975 | Fed. Rep. of Germany . |
| 1428869 | 3/1976 | United Kingdom . |

*Primary Examiner*—Gary L. Smith

*Attorney, Agent, or Firm*—Cushman, Darby & Cushman

[57] ABSTRACT

An improved automatic lens grinding machine and process for shaping lenses to fit any particular glasses frame.

The machine includes a recording assembly by which the pattern of a glasses frame which will hold a lens is recorded on a heat or photosensitive substrate. The paper and lens are mounted on a carriage assembly which is mcvable into and out of a grinding position adjacent a grinding assembly. When positioned in the grinding position, grinding is under control of a scanner assembly and a control circuit. Thus, the relevant process for automatically grinding a lens to fit any particular lens includes the steps of recording a desired pattern on a recording substrate, moving the lens into position to be ground, subsequently scanning the recorded pattern and generating signals indicating the presence or absence of the pattern earlier recorded on the heat or photosensitive substrate, sensing the contact pressure between the lens and the grinding stone and controlling the position for the lens to be ground with respect to a rotating grinder stone in response to the signals generated during the scanning and pressure sensing process.

1 Claim, 16 Drawing Figures

METHOD FOR AUTOMATICALLY GRINDING LENSES

This is a division of our application Ser. No. 690,781 filed May 27, 1776, now U.S. Pat. No. 4,096,684, which in turn was a continuation-in-part of our abandoned application Ser. No. 490,188, filed July 19, 1974.

BACKGROUND OF THE INVENTION

This invention relates to an automatic eyeglass lens grinding method and machine in which a desired shape, for example the shape of the interior of the lens frame of eyeglasses, is recorded on a substrate which is thereafter scanned. During this scanning process, electrical signals are generated which indicate the presence or absence of the recorded pattern. By controlling the movement of the lens toward and away from the grinding wheel relative to the generated signals, the lens is automatically shaped so as to correspond with the recorded pattern.

When eyeglasses, particularly for correction of vision, are formed in the conventional manner, lenses and frames of various shapes are separately stored. After correct lenses have been prescribed, a frame is selected from a wide variety of differently shaped frames and the lenses must be shaped to match with the selected frame and fixed therein.

Recently in forming the lenses by grinding, a simple grinder is used, wherein a replica pattern plate having a same shape as the eyeglass frame is used. The pattern plate is located co-axially with the axis of the objective lens to be ground, and the lens is pressed against a high-speed rotating grinder until the pattern plate communicates against a stop device which has the same radius as the outer periphery of the grinder stone. As the lens and pattern plate are turned, the lens acquires the same shape as the pattern plate. In such machine, however, many pattern plates corresponding to the various frames are required. Such a requirement is burdensome because so many frames of many various designs are available. For such purposes a machine for forming the various patterns has been developed, but the machine does not always produce the hoped for results. Applicants have found the machine has broken frames and suffers mechanical problems as well.

SUMMARY OF THE INVENTION

To overcome such drawbacks and disadvantage, the present invention and in particular the preferred exemplary embodiment disclosed herein provides an automatic lens grinding machine characterized by recording the desired pattern of a glasses frame on a heat or photosensitive substrate and subsequently controlling the position of the lens to be ground against a rotating grinder in response to signals generated during the scanning of the recorded pattern whereby a desired shaped lens is automatically produced. Thus, the relevant process for automatically grinding a lens to form a desired shape is by recording a desired pattern on a recording substrate, subsequently scanning the recorded pattern and generating first and second signals indicating the presence or absence respectively of the pattern previously recorded on the heat or photosensitive substrate, and controlling the position for the lens to be ground with respect to a rotating grinder stone in response to the signals generated during the scanning process.

BRIEF DESCRIPTION OF THE ACCOMPANYING DRAWINGS

Other features and additional details of the invention will be disclosed in the following description taken together with the accompanying drawings in which.

DESCRIPTION OF THE PREFERRED EMBODIMENTS

Figure 1:
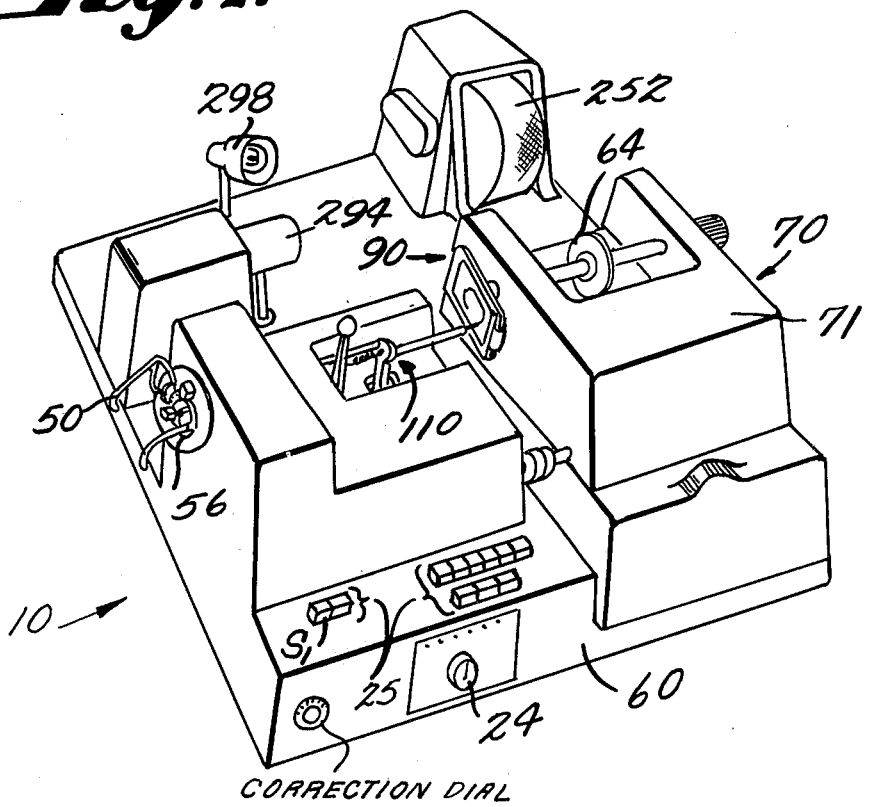
FIG. 1 is a perspective view of the preferred embodiment of device according to this invention, in which an inner periphery of the glasses frame is recorded onto recording paper.
Figure 4:
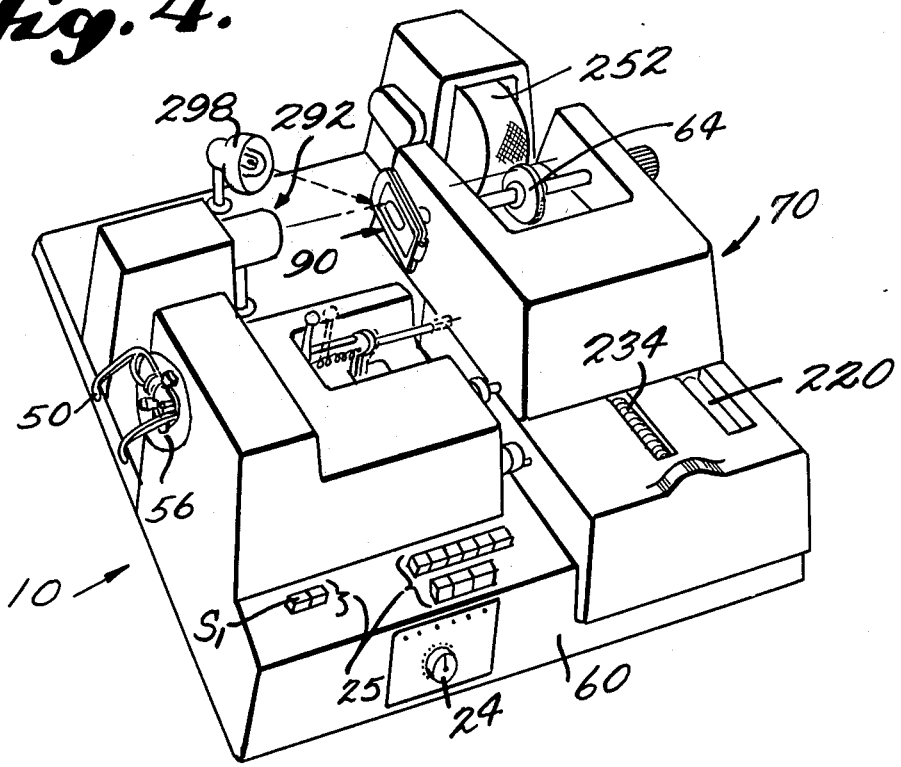
FIG. 4 is a perspective view of the device according to this invention, in which a lens is being ground.
Figure 5:
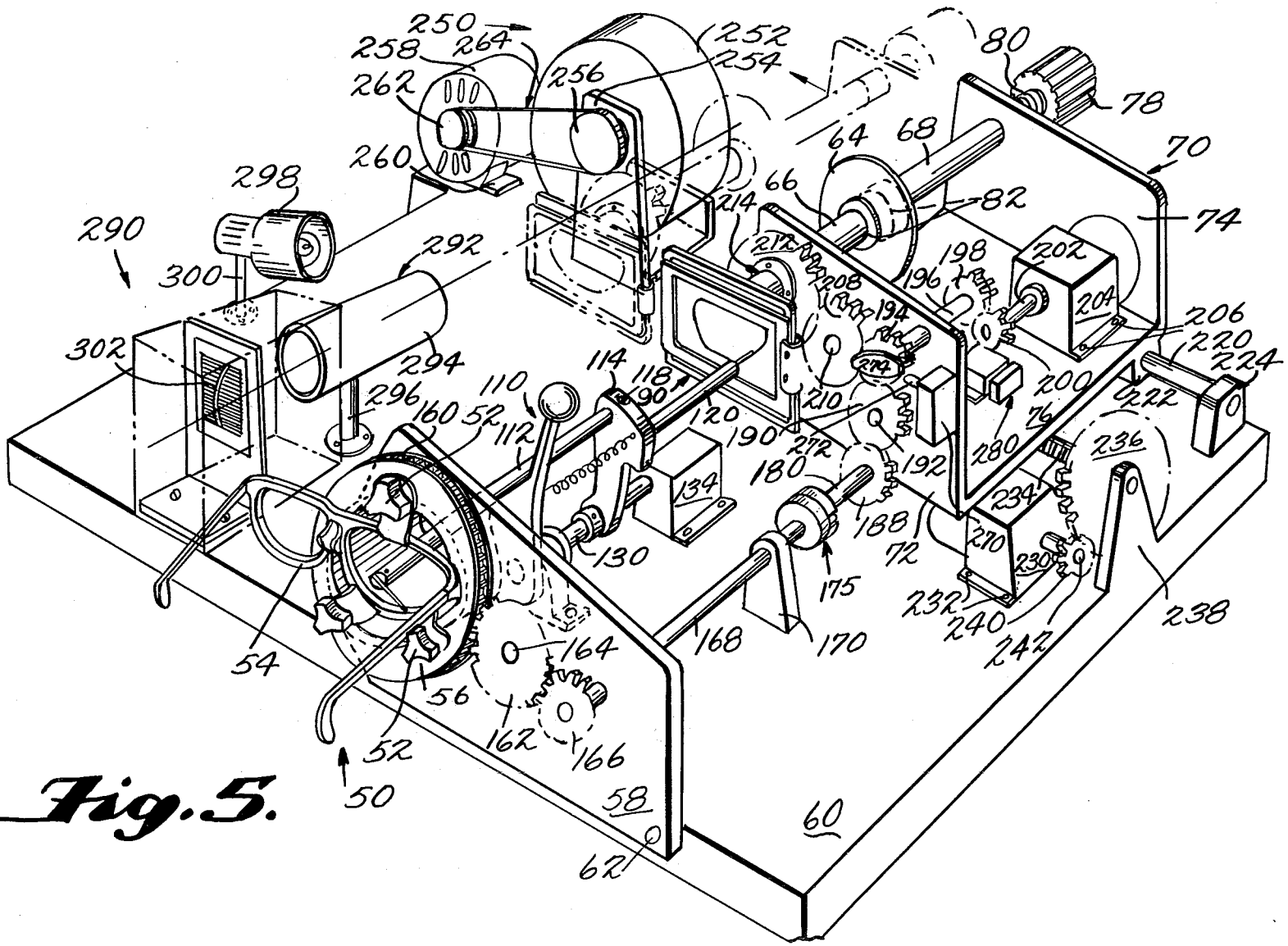
FIG. 5 is a detailed perspective view of the device shown in FIGS. 1 and 2.

FIGS. 1, 4 and 5 are perspective overall views of the present invention. FIG. 1 shows the positioning of the device during the period of the process where the glasses frame is being recorded onto the heat or photosensitive substrate. FIG. 4 shows the device positioned so that a lens is positioned adjacent a grinding stone. FIG. 5 shows a cutaway interior view of the device.

The device according to this invention, generally indicated at 10, is provided with control-buttons 25 for determining the type of grinding for the periphery of the lens with either a flat edge or a sharp edge shape or any similar convenient form. Also, a pressure volume adjusting dial 24 is provided for adjusting a preselected grinding pressure. The pressure range can vary between about 1–5 Kg, preferably about 3 Kg, and is set at a desired pressure suitable for grinding the lens. The thickness of lenses will also vary and if the thickness of the lens is very thick, the pressure will usually be set at the higher pressure of about 5 Kg. Following the setting of the desired grinding parameters the glasses frame 50 is clamped to the device 10 as described hereinafter, the lens 64 is properly positioned and the tracing system is positioned within the portion of the frame 50 being fit. Thereafter, starting switch $S_1$ can be activated.

Operating switches 25 include main on/off switches, start switch $S_1$, an emergency start switch, main motor start switches, and other necessary switches as desired.

Turning now to FIGS. 5–9, a glasses frame 50 once selected by a customer is mounted on the device generally indicated at 10 by means of adjustable mounting fingers 52 and a guide finger 54 all of which are secured to support member or chuck 56. The support member 56 is in turn rotatably mounted by any convenient means such as bearings (not shown) to a support plate 58 which is secured to base member 60 as for example by screws 62. Preferably, the support member 56 is mounted adjacent its outer periphery and is provided with a centrally located circular opening sized so as to be slightly larger than the interior periphery of the largest glasses frames manufactured.

A lens 64 is positioned in the device by being placed between axially aligned shafts 66 and 68. The shafts 66 and 68 are supported by the carriage assembly 70 which is comprised of an outer housing 71 and a generally U-shaped frame member comprised of sidewalls 72, 74 and a bottom 76. The shaft 66 is rotatably mounted in sidewall 72 by any convenient bearing means (not shown) while the shaft 68 is not only rotatably mounted in sidewall 74 by any convenient means, such as a bearing (not shown), but is additionally mounted so as to be axially adjustable as by means of the knob 78 and threads 80. The portions of shafts 66 and 68 which are in contact with the lens 64 are each provided with a suction cup 82 which will be directly in contact with the glass lens 64. The suction cups 82 would preferably be made out of any soft resilient material that will not scratch or mar the lens 64. It should be well understood, however, that a wide variety of materials could be used for the suction cups 82. Likewise, shafts 66 and 68 could be provided with any type of resilient end, it only being essential that each shaft be able to be urged into contact and securely support lens 64.

Figure 8:
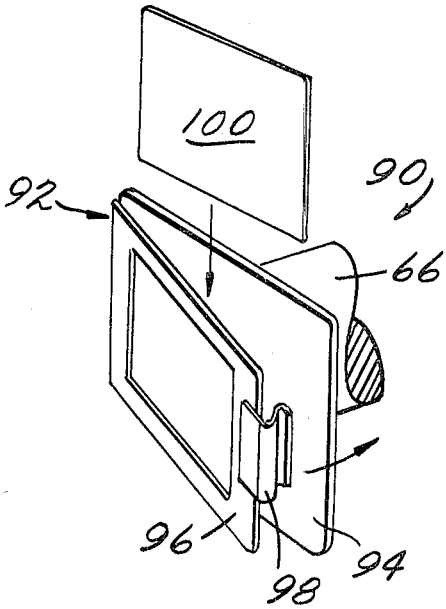
FIG. 8 is a view showing how the recording paper is set within the recording paper carrier.

Once the glasses frame 50 is in position, it is important to be able to transfer the profile of the inner shape of the glass frame to the recording assembly generally indicated at 90 in FIGS. 5 and 8. The recording assembly 90 is comprised of a holder indicated in FIG. 8 at 92 which is comprised of a back plate 94 and a hinged front mounting plate 96. A catch 98, attached to the front mounting plate 96, is provided to retain the front mounting plate 96 in a closed position against the rear mounting plate 94 with the recording paper 100, which is the heat or photosensitive substrate held therebetween. The rear mounting plate 94 is affixed to the shaft 66 which as indicated previously is rotatably mounted within the sidewall 72 of the frame member 70. Thus, the recording assembly is also positioned in axial alignment with lens 64.

Figure 2:
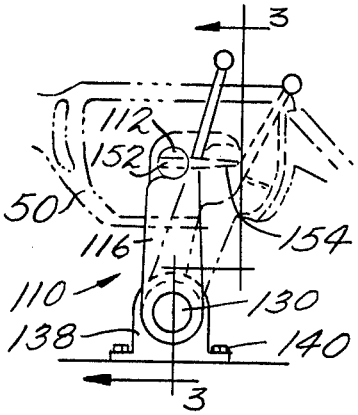
FIG. 2 is a front elevational view showing the profile tracing guide pin and in phantom lines the tracing position on the inner periphery of the spectacle frame.
Figure 3:
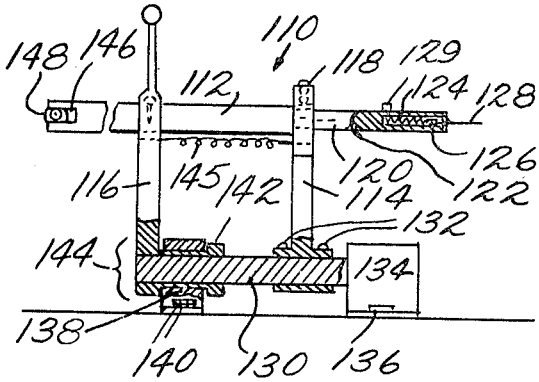
FIG. 3 is a partial cross-sectional view of the tracing lever system.

The transfer of the profile of the glasses to the recording substrate or paper 100 is accomplished by the profile assembly generally indicated at 110 and shown in FIGS. 2, 3 and 5. As best shown in FIGS. 2 and 3, the profile assembly 110 is comprised of a horizontal member 112 which is fixed to vertical support members 114 and 116 as for example by screws 118. The vertical support member 114 also supports a horizontally mounted rod 120 which has a hollowed out inner chamber 122 in which a spring 124 and a heat pen stem 126 are retained. Attached to the heat pen stem 126 is a pen 128 which is connected to a source of electrical energy and serves as a heated pen for purposes of writing on the recording paper 100.

A terminal 129 is provided on rod 120 and is connected by means of a suitable lead wire (not shown) to the heated pen stem 126. During operation, a suitable electric power source can be connected to terminal 129 so as to energize and heat pen 128.

The vertical support member 114 is secured to a shaft 130 as by means of pins 132. The shaft 130 is rotatably and slidably mounted within a housing 134 which is affixed to the base 60 as by screws 136. A bearing block 138 is attached to base 60 by means of screws 140. The vertical support member 116 is provided with an extension portion 142 which is rotatably mounted within the bearing block 138. In addition, the extension member 142 is provided with an open passageway generally indicated by the bracket 144 into which the shaft 130 is inserted so that shaft 130 is also slidably and rotatably mounted therein.

Spring 145 is provided between the vertical support members 114 and 116 and will pull the movable vertical support member 114 toward vertical support member 116 which is fixed to base 60. The housing 134 encloses an electrical coil (not shown) which surrounds rod 130. When in the recording cycle the coil within housing 134 is energized and will pull rod 130 into housing 134 thus pulling the pen 128 into contact with recording paper 100 and overcoming the pulling force of spring 145. When pen 128 is in contact with recording paper 100 spring 124 will determine the appropriate pressure between pen 128 and recording paper 100.

Figure 7:
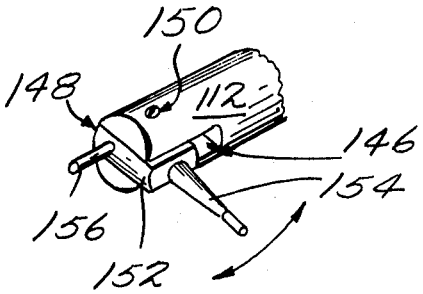
FIG. 7 is a view showing a profile tracing guide pin in detail.

As indicated previously, one end of the shaft 112 is mounted in the vertical support member 114, the opposite end of the shaft 112 is shown in detail in FIG. 7. As is shown in FIG. 7, the end of the shaft 112 is provided with a slot-shaped opening 146 into which a profile guide pin member generally indicated at 148 is rotatably mounted by means of pin 150. The profile guide member 148 is comprised of a support block 152 having pins 154 and 156 mounted therein.

As indicated previously, the glasses frame 50 once mounted on the support member 56 will be rotated, preferably incrementally, which will cause like incremental movements in the profile guide pin assembly 110. In order to form an image on the recording paper 100 it is essential that the recording assembly 90 and the support member 56 be rotated together or simultaneously. As will be more fully explained hereinafter, the recording assembly 90 and the support member 56 are connected to common drive means located within the carriage assembly 70. Thus, by rotating the recording assembly 90 and the support member 56 incrementally, an image will be formed in a similar fashion on the recording paper 100, specifically by means of the heated pen 128. The support member 56 is rotatably mounted on the support wall 58 and is provided around its periphery with recesses 160 sized to cooperate with the gear teeth on gear 162 which is fixed to support wall 58 by means of a pin 164. The gear 162 is in turn caused to rotate by means of the gear 166 which is fixed to shaft 168. The shaft 168 is rotatably mounted in the support wall 58 and in bearing block 170 which is secured by any convenient means such as welding to the base 60.

As will be more fully described hereinafter, the carriage assembly 70 together with the recording assembly 90 and the lens 64 are movable along the base 60. Thus, it is essential that the drive shaft for the support member 56 which supports the eyeglasses 50 and which is rotated together with the recording assembly 90, be provided with a coupling device generally indicated at 175 so that the driving connection can be broken to allow for such movement of carriage assembly 70.

Figure 9:
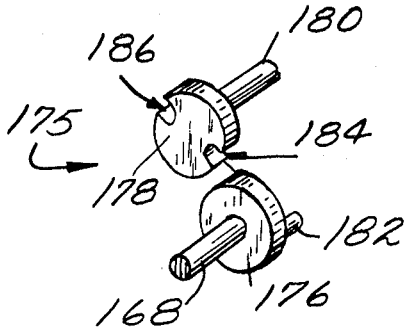
FIG. 9 is a detail view of coupling member.

As shown in detail in FIG. 9 this coupling device is comprised of two plate members 176 and 178 with plate 176 being secured to shaft 168 while plate 178 is secured to shaft 180. Plate 176 is provided with a drive lug 182 and the plate 178 is provided with notches or cutout areas 184 and 186 spaced oppositely from one another around the periphery of the plate 178. The size of the notches 184 and 186 corresponds to the size of the drive lug 182 so as to be able to mesh therewith when the plates 176 and 178 are engaged and in driving contact with lug 182 engaged with either notch 184 or 186.

Connected to the other end of shaft 180 is a gear 188 and the other end of shaft 180 is rotatably mounted in the sidewall 72. Gear 180 is in driving contact with a gear 190 which is supported by means of pin 192 secured to sidewall 72 and in turn is driven by gear 194 suitably secured to one end or shaft 196 which is itself rotatably mounted also within sidewall 72. Attached to the other end of shaft 196 is a gear 198 which is in driving engagement with gear 200 suitably secured to drive shaft 202 of the lens drive motor 204. The lens drive motor 204 is in turn suitably secured to the bottom member 76 of carriage assembly 70 as by screws 206.

The lens drive motor 204 drives lens 64 since gear 194 on shaft 196 is also drivingly engaged with gear 208 which is rotatably mounted on shaft 210 mounted in sidewall 72 and gear 208 drivingly engages a gear 212 fixed to shaft 66 by any convenient means such as coupling ring 214.

The carriage assembly 70 is slidingly mounted on guide rail 220 by slide bearing 222 secured to base member 76 by any convenient means such as welding. Guide rail 220 is respectively mounted to the base 60 by means of support block 224.

The carriage drive motor 230 is suitably attached to the base member 60 by any convenient means, such as screws 232, and provides the driving force causing the sliding movement of carriage assembly 70 along guide rail 220.

Figure 6:
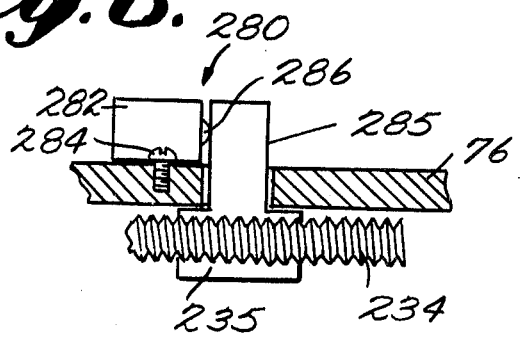
FIG. 6 is a cross-section taken along a line A-A in FIG. 5.

This sliding movement is effected by means of a threaded shaft 234 which is rotatably mounted in a complimentary threaded coupling member 235 which is in a working relationship with the bottom of plate 76 as shown in FIG. 6. The threaded rod 234 is suitably secured to a gear 236 which is rotatably supported by means of a mounting bracket 238 which is welded to the base member 60. The gear 236 is in turn driven by gear 240 which is secured to the drive shaft 242 of the carriage drive motor 230.

The grinding assembly generally indicated at 250 is comprised of a grinding stone 252 rotatably mounted within a support bracket 254 by means of an axle 256. The support bracket 254 can be mounted by any convenient means to the base member 60 such as by welding or screws (not shown). A drive motor 258, attached to the base member 60 by means of mounting brackets 260 is provided with a drive shaft 262 which is drivingly connected to the axle 256 as by means of belt 264. As shown in phantom lines, in FIG. 5, the carriage assembly 70 has been moved in the direction of the arrow toward the grinding stone 252 such that the lens 64 is placed into grinding contact with the grinding stone 252.

As indicated previously, it is important that the drive plates 176 and 178 of the coupling 175 be in a correct position to be realigned subsequent to the grinding operation. This can only be effected if one of the two notches 184 or 186 within the periphery of plate 178 are stopped at a position similar to the position when rotation of support member 56 was stopped so that one of the two notches will be able to properly engage the drive lug 182. This position is essentially as shown in FIG. 9. In order to precisely stop the lens motor 204 at the desired position, use is made of a limit switch 270 having a trip finger 272. An alliptically shaped actuator member 274 is attached to the main drive gear 194 and sized so that the trip finger 272 will be tripped as the actuator member 274 achieves a generally horizontal position. Thus, when the actuator member 274 arrives at essentially a horizontal position the trip finger 272 of the limit switch 270 will be engaged and thereby tripped causing the lens motor 204 to be stopped. The limit switch 270 is mounted as shown in FIG. 5 to the sidewall 72 of carriage assembly 70. It should be understood, however, that other arrangements could equally well be used to sense when notches 184 and 186 are in proper position to reengage drive lug 182.

During grinding it is important to be able to sense the pressure exerted by the grind stone 252 on the lens 64 and for this purpose a pressure detector generally indicated at 280 is provided. As is best shown in FIG. 6, the pressure detector 280 is positioned on base member 76 of the carriage assembly 70. The threaded coupling member 235, with which the threaded rod 234 is drivingly engaged, extends through an opening 285 in base member 76 and is in contact with a pressure sensing mechanism 282 secured to the base member 76 by any convenient means such as by mounting pins 284. The pressure sensing mechanism 282 is provided with a sensing probe 286 which is in contact with the portion of the coupling member 235 which extends above the base member 76.

Control of the grinding procedure for lens 64 is controlled by the photodetector assembly generally indicated at 290. The photodetector assembly 290 is comprised of an optical lens device 292 which is comprised of an outer housing 294 mounted to the base member 60 by means of a support stand 296. In addition, the photodetector assembly 290 is comprised of a lamp 298 likewise suitably mounted to the base member 60 as by a support device 300 and a detecting element 302 which is is axial alignment with the optical lens assembly 292.

To correct for wear of the grinding stone 252, the elements comprising the photodetector assembly 290 can be slidably mounted to base 60 as an integral unit so as to be movable along base 60. Movement therealong could be provided by means of a screw rod, (not shown), which could be connected between that integral unit and an incremental correction dial (shown in phantom in FIG. 1) mounted on the front of the device.

Figure 10:
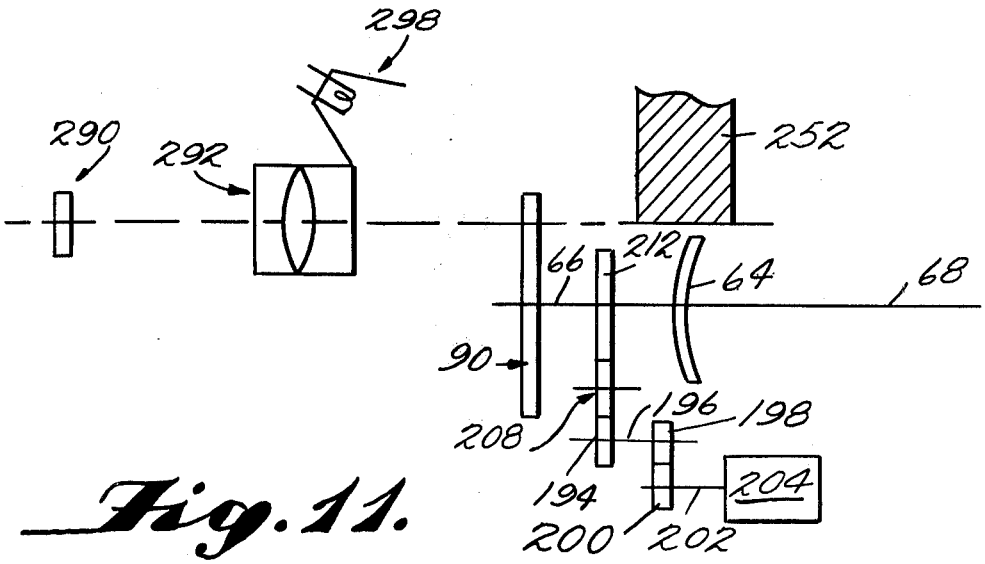
FIG. 10 is a view showing the relative locations of pattern detecting system, the grinder, the lens and the recording paper.

FIG. 10 schematically shows the relationship of the photodetector assembly 290, the optical lens assembly 292, lamp 298, the drive assembly for the lens 64, the grinding stone 252 and the recording assembly 90 when the carriage assembly 70 has moved into its grinding position.

Figure 14:
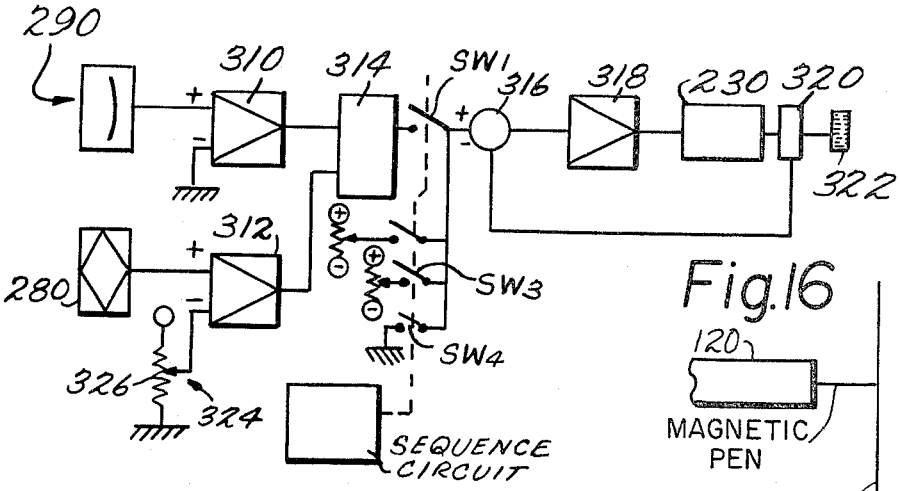
FIG. 14 is a block diagram of the control circuit.
Figure 16:
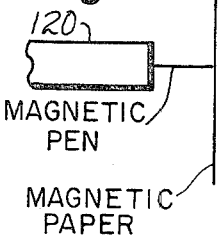
FIG. 16 is a view showing still another embodiment of the profile tracing system.

FIG. 14 comprises a block diagram setting forth the various components of the control circuit for the carriage drive motor 230. The control circuit will initially receive output signals from the photodetector assembly 290 in response to sensing or not sensing the pattern or recording paper 100 and from the pressure detector assembly 280 in response to the amount of pressure exerted by drive motor 230. The output from each of these assemblies is respectively fed through amplifiers 310 and 312 into a selection circuit 314 which in turn produces an output signal for the feedback circuit 316.

A switch SW 1 is positioned between the selection circuit 314 and the feedback circuit 316. In addition, switch SW 1, together with switches SW 2, SW 3 and SW 4 control the operation of the motor 230, and switches SW 1–SW 4 are in turn controlled by a conventional sequencing circuit shown in FIG. 14. Only one switch will be closed at a time and when switch SW 1 is closed, with switches SW 2–SW 4 open, the control circuit will be in the grinding condition and motor 230 will be operated as will be more fully described hereinafter. Switches SW 2 and SW 3 respectively control the forward and rearward movement of carriage assembly 70. After recording, carriage assembly 70 will be moved forward into grinding position and after grinding is completed, carriage assembly 70 will be moved rearwardly back to its starting position. During other periods of operation switch SW 4 will be closed. Thus, the plus input of the feedback circuit 316 can be changed causing changes in the voltages applied to motor 230. Switches SW 1–SW 4 can be, for example, analog switches or relays.

The feedback circuit 316 is connected both to the main driving circuit 318 for the motor 230 and also to a tachometer generator 230 which is positioned between gear 322 and the motor 230. Together, the driving circuit 318, the feedback circuit 316 and the generator 320 provides a speed control for motor 230 and produce a speed for motor 230 which is proportional to the input of the feedback circuit 316. Thus, motor 230 will rotate faster when the sensed signals deviate by a large degree and will rotate more slowly as the sensed signals come closer to the desired valve. In addition, the amplifier 312 is connected to a pressure adjusting switch 324 which is comprised of an adjustable resistance 326.

The operation of the device together with a further explanation of FIGS. 1–14 is as follows. Upon the starting of the operation, the position of the carriage assembly 70 will be as shown in FIG. 1, and eyeglasses frame 50 will have been properly clamped as shown. Likewise, the profile assembly 110 will have been properly positioned so that the profile pin 154 is in contact with the interior slot within one side of the glasses frame 50 with pen 128 in contact with the recording paper 100. When the proper start button is actuated and electric current is caused to flow within the plunger 126 which causes the pen 128 to be heated and ready to inscribe a profile on the recording paper 100. Thereafter, the lens motor 204 is energized which causes rotation of the gear 190 and of the support member 56. This rotation is allowed to continue until the proper pattern of the interior of the glasses frame is formed on the recording paper 100. In this way the profile of the inner periphery on one side of the glasses frame 50 is traced onto the recording paper 100 thus creating a black pattern corresponding with the width of the heated pen 128 in contact with the recording paper 100.

Upon the completion of the formation of a pattern in the recording paper 100, the lens motor 204 together with the current supplied to the electrically heated pen 128 are deenergized and the heated pen 128 is withdrawn from its contact with the recording paper 100.

At the completion of the recording process of the pattern on the recording paper 100, the drive carriage drive motor 230 is energized causing the carriage assembly 70 to move from the position shown in solid lines in FIG. 5 to the position shown in phantom lines in FIG. 5 such that the lens 64 is placed in grinding contact with grinding stone 252. Simultaneously the light projector or lamp 298 is energized along with the grinding stone drive motor 258.

When the carriage assembly 270 has arrived at the position shown in phantom in FIG. 5 the lens 64 which is to ground is in contact with the grinding stone 252 and due to the linear motion provided by the threaded rod 234 the lens 64 is pressed against the now rotating grinding stone 252 and the pressure with which the lens is pressed against the grinding wheel 252 is sensed by the pressure detector assembly 280. As shown in FIG. 14 the pressure detector 280 and the pressure adjusting switch 324 will be adjusted so that the pressure detector 280 can control the effect of drive motor 230 so as to maintain the proper pressure between the grinding stone 252 and the lens 64 during the grinding operation.

As is shown in FIG. 14, output signals from the pressure detector assembly 280 and from the photodetector assembly 290 are both fed to the selecting circuit 314 and the forward motion of carriage assembly 70 will be continued due to the driving force delivered by drive motor 230 until such time as the pattern recorded upon the recording paper 100 is detected by the photodetector assembly 290.

Referring now to FIGS. 10–14, and keeping in mind the locations of elements as shown in FIG. 10, the light coming from the lamp 298 and striking the recording assembly 90 will be reflected through optical lens assembly 292 and finally detected by the photodetector assembly 290. While the carriage assembly 70 is in the grinding position the optical lens assembly will be focused on the recording paper 100 and the photodetector assembly 290 will produce an output signal when the detecting element 302 becomes focused upon the pattern previously placed upon the recording paper 100.

Figure 11:
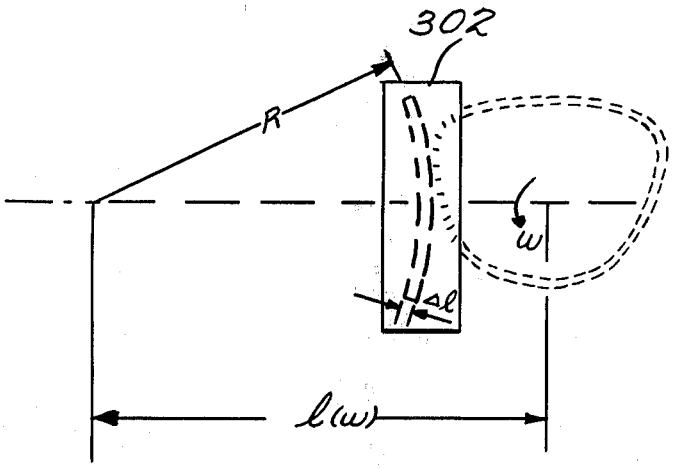
FIG. 11 is a view showing how the pattern is focused at the pattern detecting element.

FIG. 11 shows a pattern on the recording paper, focused at the detecting element 302. The detecting portion of the detecting element 302 comprises a partial arc of its circle having a radius R, which center axis is on a same horizontal plane as the rotationary axis of the grinding stone 252, and the detecting element 302 spaced at a distance of 2R to the left side.

Figure 12:
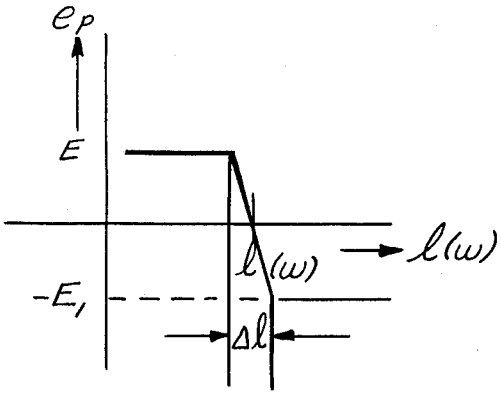
FIG. 12 is a diagram showing an output voltage of the pattern detecting element.

The pattern detecting portion comprises a body of narrow width ($\Delta l$), while the width of a curve of the pattern on the recording paper 100 is arranged to be wider than said width of $\Delta l$. FIG. 12 shows an output voltage of the detecting element 302. As the grinding of the lens proceeds, the pattern previously placed on recording paper 100 comes closer to being focused on by the detecting element 302 and finally contacts therewith. As this occurs, and output voltage $e_p$ increases from $-E_1$ and a voltage in proportion to an amplitude of the contact between the detecting element 302 and the pattern is generated.

Figure 13:
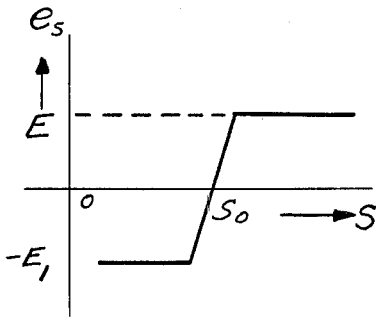
FIG. 13 is a view showing an output voltage of the pressure detector.

FIG. 13 shows an output voltage $e_s$ of the detector element 302, in which $S_o$ is a value of the pressure set by the pressure adjusting switch 24. The grinding pressure being higher than such value, $e_s$ increases, while the grinding pressure being lower than said value, $e_s$ decreases.

The output from the selecting circuit 314 is put into a motor driving circuit 318 after deducting its feedback amount from a tachometer generator 320 through a feedback circuit 316 and is then power-amplified and controls the carriage assembly drive motor 230.

When the output voltage from the selecting circuit 314 is negative, the carriage assembly drive motor 230 moves the carriage assembly 70 in proportion to each absolute voltage value in a forward direction; when the output voltage is positive, carriage assembly drive motor 230 moves the carriage assembly 70 in a rearward direction.

At the beginning of the grinding operation, the grinding is done at the predetermined pressure set by the pressure adjusting switch 324. When the pattern on recording paper 100 is projected onto the detecting element 302, the detecting voltage $e_p$ increases thereby causing the carriage assembly drive motor 230 to move the carriage assembly 70, in a rearward direction.

When the grinding pressure is detected as being zero over the entire circumference (360 degrees) of the lens, the grinding operation will be terminated. When the output voltage of pressure detector 280 is near $-E$ (see FIG. 13) grinding pressure will almost be zero and when the voltage level is maintained, which can be for a specific length of time under the control of a timer (not shown) the grinding cycle can be terminated and the carriage assembly 70 will be moved back to its starting position.

When grinding operation is repeated with several grinding stones 252, repetitive work can be done for different lenses 64 for the same frame shape.

When grinding of the lens 64 is completed, the lens motor 204 detects its proper stop position by means of limit switch 270 thereby allowing the recoupling of the coupling assembly 175, when the carriage assembly drive motor 230 moves the carriage assembly 70 back to its initial start position. At this point, one cycle of the operation will be completed.

Figure 15:
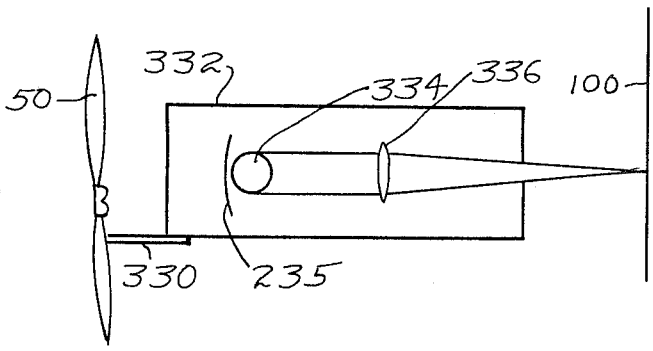
FIG. 15 is a view showing another embodiment of the profile tracing system.

As a modification of the profile guide assembly 110 previously described, an optical assembly as shown in FIG. 15 could equally be as well used. Such a modified profile producing assembly could be comprised of a tracing finger 330 which would be placed within the interior of one side of a glasses frame again shown at 50. The tracing finger 330 would be suitably attached to a housing 332 which would support a lamp 334, reflector 235, and a suitable lens assembly 336 which would cause the light beam emitted by the lamp 334 to be focused as a point source upon the recording paper 100. As was the case with profile guide assembly 110, as the guide finger 330 traces the inner profile of the glasses frame 50, the beam of light from lamp 334 suitably focused onto the recording paper 100 by the lens assembly 336 would cause a pattern corresponding to the inner profile of frame 50 in which the finger 330 is positioned to be formed on the recording paper 100. In addition, instead of using a heated pen such as the one shown at 128, a magnetic pen and magnetic sensitive paper could equally well be used.

It will now be clear that there has been provided herein a device which accomplishes the objectives heretofore set forth. While the invention has been disclosed in a preferred form, it is to be understood that the specific preferred embodiment thereof as described and illustrated herein is not to be considered in a limiting sense as there may well be other forms or modifications of the preferred embodiment which should also be construed as coming within the scope of the appending claims.

What is claimed is:

1. A process for automatically grinding lenses for glasses in a lens grinding device comprising the steps of:

securing a glasses frame in the device;

recording a pattern on a recording substrate corresponding to the portion of the glasses frame where the ground lens is to be positioned;

moving the lens to be ground in to a grinding position adjacent a grinding stone;

scanning the recorded pattern and generating a first electrical signal in response to sensing the absence of the recorded pattern and a second electrical signal in response to sensing the presence of the recorded pattern;

sensing the pressure when the lens and grinding stone are in contact and generating an electrical signal in response to such pressure and controlling the positioning of the lens to be ground with respect to the grinding stone in response to the generated electrical signals produced so that grinding continues until the recorded pattern is sensed.

* * * * *

UNITED STATES PATENT AND TRADEMARK OFFICE

CERTIFICATE OF CORRECTION

PATENT NO. : 4,217,736

DATED : August 19, 1980

INVENTOR(S) : Hayao AKABA, Akira IKEDA & Masayoshi LEE

It is certified that error appears in the above-identified patent and that said Letters Patent are hereby corrected as shown below:

In the heading

Please correct:

Related U.S. Application Data

[60] "Division of Ser. No. 690,781, May 27, 1977" to read: -- Division of Ser. No. 690,781, May 27, 1976 --

Signed and Sealed this

Tenth Day of November 1981

[SEAL]

*Attest:*

GERALD J. MOSSINGHOFF

*Attesting Officer*

*Commissioner of Patents and Trademarks*